United States Patent [19]

Falconieri et al.

[11] Patent Number: 4,904,097

[45] Date of Patent: Feb. 27, 1990

[54] CARTRIDGE FOR A PRINTING RIBBON

[75] Inventors: Remo Falconieri, S. Giorgio C.se; Sergio Uggetti, Ivrea, both of Italy

[73] Assignee: Ing.C. Olivetti & C., S.p.A., Ivrea, Italy

[21] Appl. No.: 259,417

[22] Filed: Oct. 19, 1988

Related U.S. Application Data

[63] Continuation of Ser. No. 95,219, Sep. 11, 1987, abandoned.

[30] Foreign Application Priority Data

Sep. 11, 1986 [IT] Italy ..... 67702 A/86

[51] Int. Cl.[4] ..... B41J 32/00; B41J 35/04

[52] U.S. Cl. ..... 400/248; 400/208

[58] Field of Search ..... 400/248, 208

[56] References Cited

U.S. PATENT DOCUMENTS

| | | | |
|---|---|---|---|
| 3,900,099 | 8/1975 | Hengelhaupt | 400/248 |
| 3,960,259 | 6/1976 | Guerrini et al. | 400/248 |
| 4,003,460 | 1/1977 | Gray et al. | 400/248 |
| 4,084,683 | 4/1978 | Moss | 400/248 |
| 4,397,575 | 8/1983 | Aldrich | 400/248 |
| 4,601,596 | 7/1986 | Musso | 400/697.1 |
| 4,645,363 | 2/1987 | Andersson | 400/248 |
| 4,660,902 | 6/1987 | Ukmar et al. | 400/248 |
| 4,728,207 | 3/1988 | Foster | 400/248 |

FOREIGN PATENT DOCUMENTS

| | | | |
|---|---|---|---|
| 2930115 | 2/1981 | Fed. Rep. of Germany | 400/248 |
| 3110952A1 | 3/1981 | Fed. Rep. of Germany | 400/248 |
| 3529750 | 2/1987 | Fed. Rep. of Germany | 400/248 |
| 56-895 | 5/1981 | Japan | 400/248 |
| 194882 | 11/1984 | Japan | 400/248 |
| 160279 | 7/1986 | Japan | 400/248 |

OTHER PUBLICATIONS

Kockler et al., "Uniform Ribbon Tension . . . ", Xerox Disclosure Journal, vol. 4, No. 2, pp. 181–182, 3/4–79.

Plaza, "Multi-Track Ribbon Lift Control", Xerox Disclosure Journal, vol. 4, No. 3, p. 413, 5/6–79.

Sendelweck et al., "Ribbon Lift Guide Motion", IBM Technical Disclosure Bulletin, vol. 13, No. 12, p. 3671, May, 71.

*Primary Examiner*—William Pieprz

*Attorney, Agent, or Firm*—Banner, Birch, McKie & Beckett

[57] ABSTRACT

A cartridge for a printing ribbon for a typewriter having a character-carrying disc comprises a casing and two oscillating arms between the ends of which a run of the ribbon extends in a straight line on the outside of the casing between the disc and the platen. The arms oscillate from a rest position in which they make the typing point visible, to three or more working positions in which they make it possible to print using one of three tracks of the ribbon. The two oscillating arms are pivoted by means of pins on seats of fixed supports of the casing. Pivotally mounted at the free end of each arm is a guide element, a stem of the guide element being received in a sleeve of the arm. Each guide element is thus capable of modifying its angular position with respect to the respective arm in response to the selection movement so that the ribbon is always held in tension in a uniform manner, irrespective of the track selected.

5 Claims, 3 Drawing Sheets

CARTRIDGE FOR A PRINTING RIBBON

This application is a continuation of application Ser. No. 095,219 , filed Sept. 11, 1987.

BACKGROUND OF THE INVENTION

The present invention relates to a cartridge for a printing ribbon for a typewriter or other printer, for example of the type having a character-carrying disc, comprising a printing ribbon having a plurality of tracks which can be selected for the printing operation, a casing for the ribbon, a pair of terminal portions provided with guide elements between which an external run of the ribbon extends, the guide elements being movable relative to each other and with respect to the casing, for the selection of one of the tracks while maintaining uniform tension across the width of the ribbon.

Such a cartridge is known from EP No. 0 118 238, in which the terminal portions are oscillating arms and in which the guide elements are integral with the arms, which oscillate to move the selected track into a position in front of the character-carrying disc. The guide elements co-operate with two corresponding control cams which are fixed with respect to the casing and which modify the inclination of the guide elements during the oscillation movement of the arms from the viewing position to the various heights involved in track selection. The tension of the ribbon in its various working conditions is thus kept constant across the width of the ribbon. The use of this known cartridge is particlarly advantageous in machines of the type referred to as 'aisywheel' machines in which the ribbon has a very small space between the platen roller and the daisywheel itself. However the cartridge suffers from the disadvantage of impairing vision in the region of the line of typing adjacent to the control cams for the guide elements.

SUMMARY OF THE INVENTION

The object of the present invention is therefore to provide a cartridge for a printing ribbon which is simple and reliable and which makes it possible for the ribbon always to be uniformly tensioned both in its rest position and in its various working positions and which permits optimum visibility for the line of typing.

To that end, the cartridge according to the invention is characterised in that the guide elements are pivotally connected to the terminal portions in such a way that they can turn freely to assume attitudes maintaining the uniform tension irrespective of the track selected.

BRIEF DESCRIPTION OF THE DRAWING

The description hereinafter sets forth a preferred embodiment of the invention which is given by way of non-limiting example with reference to the accompanying drawing in which:

Referring to FIG. 1, the cartridge which is indicated generally by reference numeral 11 comprises a casing 12 of plastics material, which is of substantially parallelepipedic shape and which is designed to accommodate a typing or printing ribbon 13. The casing 12 comprises a bottom 14 and a series of walls 16, 17 and 18 which rearwardly define a space 19 for accommodating the upper part of a typing arrangement, for example a character-carrying disc 21 and a striker 22 which are disposed in front of a conventional platen roller 23 which defines a typing point 24 (see FIG. 2). The character-carrying disc 21 (FIG. 1), the striker 22 and the roller 23 are known per se and are therefore shown diagrammatically by dash-dotted lines in the drawings. The casing 12 is closed upwardly by a cover 26 and is defined by a front wall 27 and side walls 28, 29, 31 and 32.

Figure 2:
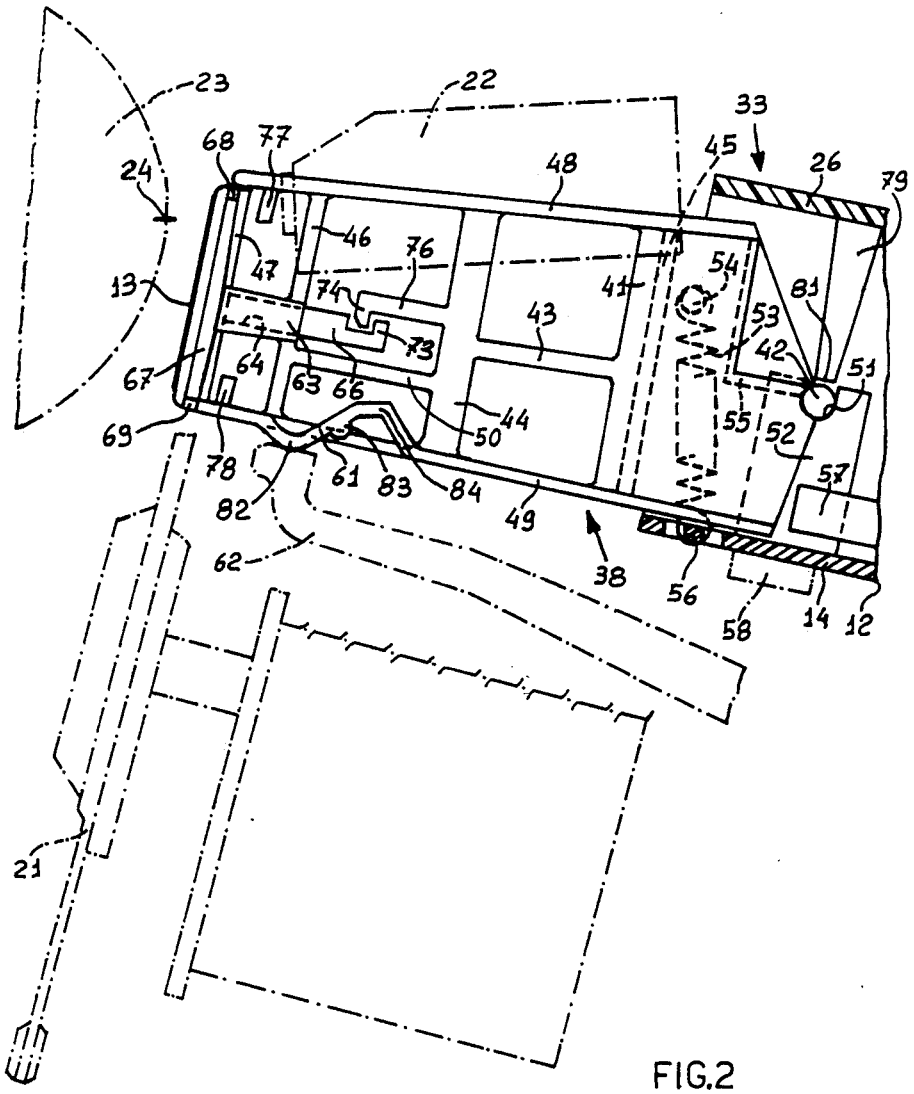
FIG. 2 is a partial longitudinal view of some details of the cartridge shown in FIG. 1, on an enlarged scale, in a working position.
Figure 4:
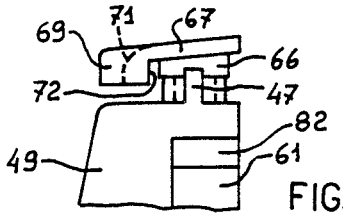
FIG. 4 is a partial plan view of some details from FIG. 1 on an enlarged scale, viewed from the bottom of the cartridge.

The casing 12 comprises two arm portions 33 and 34 which project from the rear wall 17 and which have two openings 36 and 37 respectively arranged to accommodate a pair of oscillating arms, a right-hand arm 38 and a left-hand arm 39. Each oscillating arm 38 and 39 (see FIG. 2) comprises a central portion 41 substantially perpendicular to the bottom 14, housed within the arm portions 33 and 34 and having a horizontal pin 42 parallel to the bottom 14, a series of ribs 43, 44, 45, 46, 47, 50 and 55 and two plate portions, an upper portion 48 and a lower portion 49, which taper towards the rear. Each oscillating arm 38 and 39 is in one piece and oscillates vertically by means of the pin 42 which is pivotally mounted in two seats 51 on two supports 52 projecting from the bottom 14 of the casing 12. Each oscillating arm 38 and 39 is of a very rigid structure capable of ensuring a predetermined degree of compactness and strength such as to prevent any flexing phenomena at the arms themselves. Furthermore, the spacing between the two supports 52 is such as to ensure only vertical oscillating movements at the respective oscillating arms 38 and 39, as can be clearly seen from the various Figures of drawings. A spring 53 fitted between a pin 54 on the central portion 41 and a stop 56 on the bottom 14 holds the respective oscillating arm 38 and 39 in the lowered position which permits viewing of the characters which have been printed along the line defined by the typing point 24.

Figure 1:
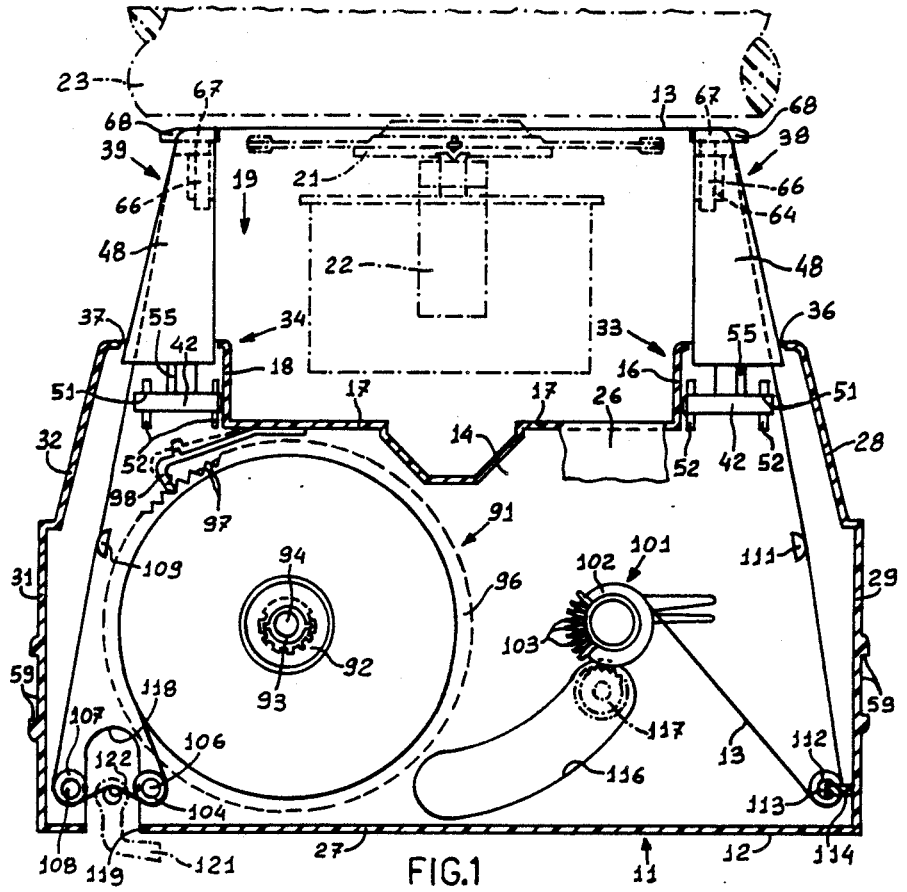
FIG. 1 is a partial plan view of a cartridge according to the invention.

If the cartridge 11 is removed from the machine, the spring 53 holds each oscillating arm 38 and 39 arrested against a shoulder 57 on the casing 12. The cartridge 11 can be removably fixed on a fixed support 58 of the typewriter in known manner, for example by means of two resilient plate members arranged to engage the appropriate seating portions 59 (see FIG. 1) on the casing 12. When the cartridge is fitted into a machine, the spring 53 (see FIG. 2) holds the respective oscillating arm 38 and 39 in a condition of bearing with a suitably shaped element 61 against a lifting device 62. The device 62 comprises a pair of levers which are pivoted to the frame of the machine and which are controlled by a three-lobe cam for simultaneously raising the right-hand and left-hand oscillating arms 38 and 39 from the viewing position into three working positions. The fixed support 58 is indicated diagrammatically while the resilient plate portions which do not form subject-matter of the present patent are not illustrated. The raising device 62 is also illustrated diagrammatically while the three-lobe cam is not shown. The device 62 and the three-lobe cam are also not described since they are substantially similar to those described in U.S. Pat.. No. 4,601,596 issued on 22nd July 1986 and assigned to Ing. C. Olivetti & C. S.p.A.

Figure 5:
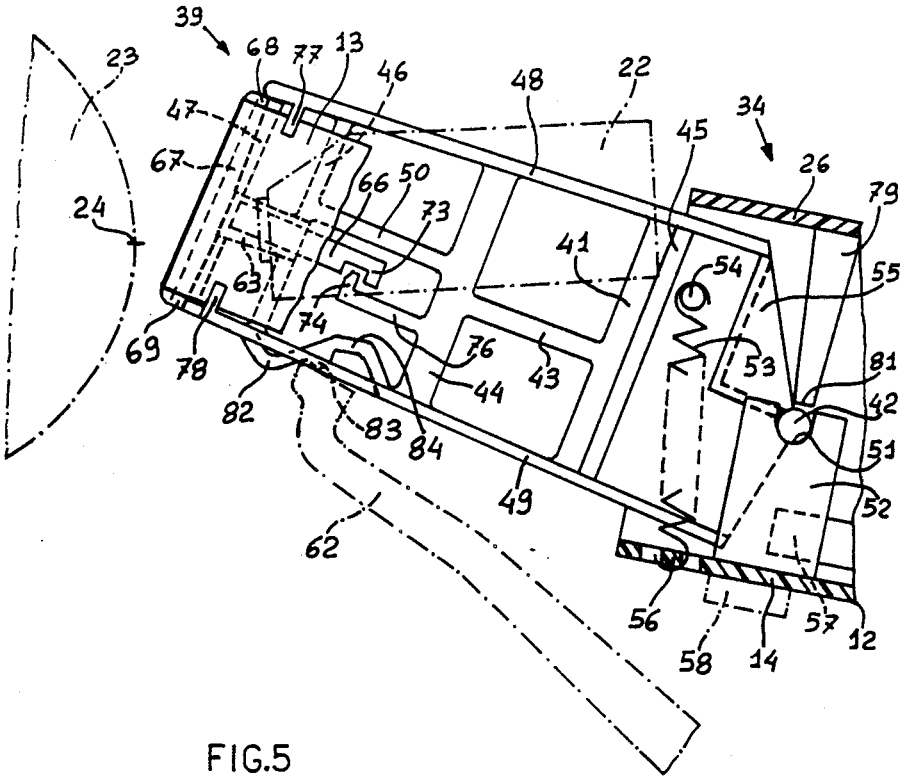
FIG. 5 is a partial longitudinal view of other details of the cartridge in FIG. 1 on an enlarged scale in a second working position.

Each oscillating arm 38 and 39 comprises in its terminal portion and in a central zone between the portions 48 and 49, a sleeve 63 which is disposed between the ribs 46 and 47 and which is fixed with respect thereto, having a cylindrical seat 64 for freely accommodating a central stem 66 of a guide element 67. The guide element 67 is disposed at the end of the respective oscillating arm 38 and 39 and comprises a main front plate which is perpendicular to the pivotal axis defined by the stem 66 and sleeve 63 and defines the plane of the external run of the ribbon, parallel to the platen 23. A rearwardly turned flange 71 on the outer edge of each plate guides the ribbon on to the plate. Lugs 68 and 69 at the top and bottom of the flange 71 confine the ribbon vertically Each guide element 67 further comprises an internal shoulder 72 for limiting the rotary and oscillatory movement of the guide element 67, by engaging the rib 47 of the respective oscillating arm 38 and 39. The two guide elements 67 are identical to each other and are symmetrical with respect to a central plane and are mounted upside down relative to each other in the respective seats 64 (see FIG. 2). Each stem 66 has at its free end a tooth 73 co-operable with a tooth 74 of an arresting element 76 which is fixed with respect to the rib 44. The teeth 74 of the two arms 38 and 39 are directed in mutually opposite directions and prevent each guide element 67 from being disengaged from the respective oscillating arm 38 and 39, as will be clearly visible from FIGS. 2 and 5.

Figure 6:
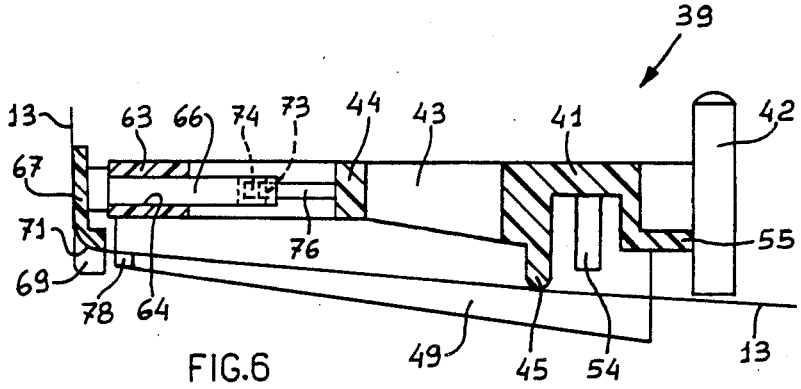
FIG. 6 is a view in section of part of the details shown in FIG. 5.

The upper plate portion 48 and the lower plate portion 49 each have a tongue portion 77 and 78 projecting from the plane of the respective plate portion, downwardly in regard to the upper plate portion 48 and upwardly in regard to the lower plate portion 49. Each tongue portion 77 and 78 is arranged to provide lateral guidance for the ribbon 13 towards the respective guide element 67. The rib 45 (see FIG. 6) also prevents the ribbon 13 from coming into contact with the sleeve 63 and the teeth 73 and 74.

Projecting from the cover 26 (see FIGS. 2 and 5), within the casing 12, are two tongue portions 79 whose ends 81 are disposed adjacent to the respective pins 42 and which do not permit the pin 42 from coming out of the seats 51 due to unforeseen and violent shocks, when the cartridge (11) is removed from the typewriter.

Housed within the casing 12 (see FIG. 1) is a supply reel indicated generally at 91, on which the typing ribbon 13 is wound. The supply reel 91 comprises a metal tube 92 which is rotatable with a sleeve 93 rotatably carried on a pin 94 which projects from the bottom 14 and a flange 96 which is fixed to the sleeve 93 in the lower part thereof. The flange 96 is provided on its outside edge with a series of peripheral recesses 97 co-operable with a resilient blade member 98 disposed on the bottom 14 of the casing 12, to prevent casual rotation of the supply reel 91 and thus uncontrolled unwinding of the ribbon 13.

Accommodated within the casing 12 is a take-up reel which is indicated generally at 101 and on to which the ribbon 13 is wound after it has been used at the typing point 24. The take-up reel 101 is formed by a metal tube 102 having on its upper end a series of recesses 103 which project from the cover 26 and which are arranged to be engaged manually for manual rotation thereof.

The supply reel 91 and the take-up reel 101 with the functional parts of the casing 12 are substantially similar to those described in published European patent application EPO No. 118 238 and they are therefore only partially described and illustrated herein.

The printing ribbon 13 which is unwound from the supply reel 19 is guided around a first roller 104 rotatable on an axis member 106 and then a second roller 107 which is rotatable on an axis member 108, to engage with the semicylindrical projection 109. The axis members 106 and 108 and the semicylindrical projection 109 project from the bottom 14 of the casing 12. The ribbon 13 is guided to pass through the opening 37 towards the guide element 67 of the left-hand oscillating arm 39, engaging the wall portion 71 to be guided parallel to the platen roller 23 until engaging the wall portion 71 of the guide element 67 of the right-hand oscillating arm 38. The ribbon 13, by way of the opening 36, engages a semicylindrical projection 111 and is guided around a roller 112 which is rotatable on an axis member 113 to be wound around the take-up reel 101. The semicylindrical projection 111 and the axis member 113 project from the bottom 14 of the casing 12. Provided on the end of the roller 112 is a lug 114 which projects from the cover 26 and which is arranged to guide the ribbon 13 vertically to prevent unwanted vertical movements of the ribbon 13.

The casing 12 comprises an opening 116 in the form of a sector of a circle, disposed adjacent to the take-up reel 101. The opening 116 is arranged to accommodate a toothed wheel 117 co-operable with the ribbon 13 which is wound on the take-up reel 101, to wind the ribbon 13 thereon. The provision of a single line of teeth on the toothed wheel 117 ensures that the ribbon 13 is pulled uniformly and parallel to the axis of the take-up reel 101. The toothed wheel 117 is known per se and is therefore shown only in diagrammatic form and is not described in detail.

The bottom 14 and the wall 27 of the casing 12 are further provided with openings 118 and 119 adjacent to the region of the ribbon 13 which is between the rollers 104 and 107. The openings 118 and 119 are to accommodate a lever 121 of the machine. The lever 121 performs the function of a dancer or jockey member and regulates unwinding of the ribbon 13 from the supply reel 91, defining a V-shaped loop 122 in the ribbon 13 which is disposed between the rollers 104 and 107. That action is combined with that of the resilient blade member 98 against the peripheral teeth 97 in such a way that the ribbon 13 is always taut. One end of the ribbon 13 is fixed to the tube 92 of the supply reel 91 and the lever 121 also signals to the machine complete unwinding of the ribbon 13 from the reel 91 when the tension in the ribbon 13 eliminates the loop 122 in the ribbon 13.

Figure 3:
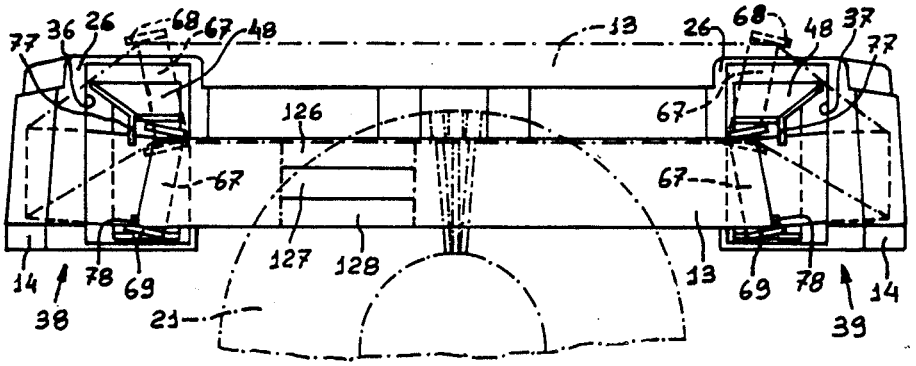
FIG. 3 is a partial front view of the cartridge shown in FIG. 1, in two working positions, on an enlarged scale.

Typing is effected by sequentially using three tracks 126, 127 and 128, as partially shown in diagrammatic form only in a part of the ribbon 13 in FIG. 3 in order to simplify the drawing, the tracks 126 to 128 being disposed at three different levels on the printing ribbon 13. Referring to FIG. 3, the ribbon 13 is shown in solid lines in the viewing position in which it is possible to see the characters typed along the line defined by the typing point 24, and in dash-dotted lines in the position for selection of the highest track. Due to the substantial travel movement of the oscillating arms 38 and 39 required to provide for the viewing position of the ribbon and the position for selection of the highest track thereon, the edges of the ribbon 13 would tend to become tight and slack alternately, with the risk of interfering with the petals of the character-carrying disc 21. Those disadvantages are eliminated by the guide elements 67 which are pivoted to the respective oscillating arms 38 and 39 and which are capable of freely modifying their angular position with respect to the oscillating arms 38 and 39 in response to the selection movement in such a way as to produce constant tension at the edges and at the middle section of the ribbon 13, independently of the selected track. In use, tensioning of the ribbon 13 is ensured by the action of the toothed wheel 117 (FIG. 1) and the counteracting force of the lever 121 while the two oscillating arms 38 and 39 move in two mutually parallel vertical planes which are perpendicular to the roller 23, by virtue of the lifting device 62 (see FIGS. 2 and 5). The device 62 positions the two oscillating arms 38 and 39 selectively at different heights to bring the first printing track 126, the second printing track 127 or the third printing track 128 in front of the typing point.

At the same time as the arms 38 and 39 are lifted, the guide elements 67 which are pivotally mounted by the stems 66 in the cylindrical seats 64 are subjected at the guide edges 71 to different levels of tension by virtue of the tension in the ribbon 13 on the guide elements 67. In particular if the upper track is subjected to a higher level of tension than the lower track, the upper parts of the guide elements 67 will tend to move towards each other and the lower parts will tend to move away from each other in converse relationship until reaching a new condition of equilibrium, as clearly shown in FIG. 3. The guide elements 67 therefore rotate in the clockwise or anti-clockwise direction, thus modifying their angular position with respect to the arms 38 and 39 from time to time for re-balancing the tension as between the various tracks and in such a way as to maintain a constant level of tension as between the various tracks on the ribbon 13. Referring to FIG. 3, clearly visible therein is the angular movement of each guide element 67 with respect to the respective oscillating arms 38 and 39. In the position for viewing of the typing, the guide element 67 of the oscillating arm 38 is rotated in the clockwise direction while the guide element 67 of the oscillating arm 39 is rotated in the anti-clockwise direction. While the ribbon 13 is lifted, it will be noted that the guide element 67 of the oscillating arm 38 rotates in the anti-clockwise direction while the guide element 67 of the oscillating arm 39 rotates in the clockwise direction until reaching the position shown in dash-dotted lines in FIG. 3, without being controlled by any member, but as the result of restoring a condition of equilibrium as between the tension at the various tracks. It will be clear therefore that the angular displacement of each guide element 67 compensates for the variations in tension and as a result makes it possible to produce constant tensioning of the ribbon 13 both at the upper edge and at the lower edge, thus maintaining the ribbon 13 constantly taut.

The cartridge is interchangeable with that described in abovementioned European patent application EPO No. 0118238 but in comparison therewith it provides for better visibility at the locations of the guide elements by virtue of the absence of the cam components which in that arrangement control the inclination movement of the guide elements.

In order to ensure correct positioning of the various tracks in spite of the different pivot points as between the oscillating arms of the cartridge of the above-mentioned European patent application and the cartridge in accordance with the present application, the shaped element 61 (see FIGS. 2 and 5) comprises a first cam 82 projecting downwardly from the plane of the lower plate portion 49 and a second cam 83 which is fixed with respect to a wall 84 projecting upwardly from the plane of the lower plate portion 49. As can be clearly seen from the drawing in FIG. 2 in which the oscillating arm 38 is in the position for viewing the typing point 24 and FIG. 5 in which the oscillating arm 39 is in the position for selection of the highest track, the lifting device 62 engages the first cam 82 and then continuing to move upwardly engages the second cam 83, thus providing for correct positioning of the three tracks 126, 127 and 128 in front of the typing point 24.

It will be appreciated that the cartridge 11 for the printing or typing ribbon 13 may be the subject of modifications and improvements both in regard to the form and the arrangement of the various components and elements without departing from the scope of the invention.

In particular, a first alternative form of the spring 53 (see FIG. 2) may consist of a spring fitted between the upper plate portion 48 and the bottom of the cover 26. A second alternative form may consist of a wire spring fitted between the oscillating arm and the casing, substantially similar to that described in above-mentioned European patent application EP No. 0118 238. A third alternative form may consist of a spring fitted between the lower plate portion 49 and the bottom of the casing 12. A fourth alternative form may consist of a pin-type spring disposed between the casing 12 and the oscillating arms 38 and 39.

The structure of the oscillating arms 38 and 39 may also be varied, by increasing the ribs and thus decreasing the internal walls in such a way as further to reduce the weight of the arms themselves without however reducing the rigidity of the structure thereof.

What we claim is:

1. A cartridge for a printing ribbon for a typewriter of the type comprising a platen roller having a typing point, a printing ribbon having a plurality of tracks which can be selected for the printing operation, a casing for housing the printing ribbon having a pair of oscillating arms having terminal portions and movably mounted in the casing from a rest position wherein the typing point is visible to successive printing positions wherein the plurality of tracks are positioned in front of the typing point, wherein said casing and said pair of oscillating arms define a combination comprising:

two arm portions projecting from the casing toward the platen roller and having two openings respectively arranged to accommodate the pair of oscillating arms;

two supports positioned in said two arm portions adjacent to the respective openings comprising two seats respectively;

two pins each fixed at one end of each oscillating arm, wherein the pair of oscillating arms are movable on two vertical planes substantially parallel therebetween and perpendicular to the platen roller by means of said pins which are pivotally mounted in the respective seats;

two tongue portions positioned in said two arm portions opposite to said two supports having their ends positioned adjacent to the respective pins for preventing the disengagement of the pins from the respective seats;

two guide elements each positioned at the other end of each oscillating arm, opposite to the pin and pivotally mounted with respect to the respective oscillating arm during the selection of one of the plurality of tracks while maintaining uniform tension across the width of the printing ribbon, wherein each guide element comprises a cylindrical stem and a main front plate which is perpendicular to a pivotal axis defined by the cylindrical stem and defines the plane of the external run of the printing ribbon parallel to the platen roller, each of the other ends of the pair of oscillating arms comprises a central sleeve having a cylindrical seat for freely housing the cylindrical stem of the corresponding guide element, said two guide elements are pivotally mounted to move in a clockwise or counterlockwise direction on two planes substantially coplanar therebetween, parallel to the platen roller and perpendicular to the vertical planes through the cylindrical stems which are freely housed in the cylindrical seats, and wherein the tension of the printing ribbon is capable of freely modifying the angular positions of the guide elements in such a way that they turn one in the clockwise direction and the other in the counterclockwise direction, modifying their angular positions with respect tot he oscillating arms from time to time for re-balancing the tension and for maintaining a constant and uniform tension at the edges and at the middle section of the printing ribbon independently of the selected track during the movements from the rest position to the successive printing positions of the pair of oscillating arms and vice versa, wherein each of the guide elements comprises an internal shoulder, and wherein each oscillating arm comprises an arresting element cooperative with the internal shoulder for limiting the rotary movement of each of said guide elements.

2. A cartridge for a printing ribbon for a typewriter of the type comprising a platen roller having a typing point, a printing ribbon having a plurality of tracks which can be selected for the printing operation, a casing for housing the printing ribbon having a pair of oscillating arms having terminal portions and movably mounted in the casing from a rest position wherein the typing point is visible to successive printing positions wherein the plurality of tracks are positioned in front of the typing point, wherein said casing and said pair of oscillating arms define a combination comprising:

two arm portions projecting from the casing toward the platen roller and having two openings respectively arranged to accommodate the pair of oscillating arms;

two supports positioned in said two arm portions adjacent to the respective openings comprising two seats respectively;

two pins each fixed at one end of each oscillating arm, wherein the pair of oscillating arms are movable on two vertical planes substantially parallel therebetween and perpendicular to the platen roller by means of said pins which are pivotally mounted in the respective seats;

two tongue portions positioned in said two arm portions opposite to said two supports having their ends positioned adjacent to the respective pins for preventing the disengagement of the pins from the respective seats;

two guide elements each positioned at the other end of each oscillating arm, opposite to the pin and pivotally mounted with respect to the respective oscillating arm during the selection of one of the plurality of tracks while maintaining uniform tension across the width of the printing ribbon, wherein each guide element comprises a cylindrical stem and a main front plate which is perpendicular to a pivotal axis defined by the cylindrical stem and defines the plane of the external run of the printing ribbon parallel to the platen roller, each of the other ends of the pair of oscillating arms comprises a central sleeve having a cylindrical seat for freely housing the cylindrical stem of the corresponding guide element, said two guide elements are pivotally mounted to move in a clockwise or counterclockwise direction on two planes substantially coplanar therebetween, parallel to the platen roller and perpendicular to the vertical planes through the cylindrical stems which are freely housed in the cylindrical seats, and wherein the tension of the printing ribbon is capable of freely modifying the angular positions of the guide elements in such a way they turn one in the clockwise direction and the other in the counterclockwise direction modifying their angular positions with respect to the oscillating arms from time to time for re-balancing the tension and for maintaining a constant and uniform tension at the edges and at the middle section of the printing ribbon independently of the selected track during the movements from the rest position to the successive printing positions of the pair of oscillating arms and vice versa, wherein each stem of the guide element includes a notched portion and wherein each oscillating arm further comprises a tooth element cooperating with the notched portion of a corresponding stem housed in said central sleeve to prevent disengagement of the cylindrical stem from the central sleeve.

3. A cartridge for a printing ribbon for a typewriter of the type comprising a platen roller having a typing point, said cartridge comprising a printing ribbon having a plurality of tracks which can be selected for the printing operation, a casing for housing the printing ribbon, a pair of oscillating arms carrying two corresponding guide elements for guiding an external run of printing ribbon, oscillation supporting means for oscillatably mounting said oscillating arms in said casing around an oscillating axis, wherein said oscillating axis is parallel, in use, to the platen roller and wherein said oscillating arms are movable from a rest position wherein the typing point is visible to successive printing positions wherein the plurality of tracks are selectively positionable in front of the typing point, and uniforming means for making uniform the tension on said tracks during the oscillations of said oscillating arms, said uniforming means comprising:

said guide elements comprise two corresponding edges which define a common plane for said external run of printing ribbon; and pivoting means for pivotally mounting each guiding element on a first end of said oscillating members and around a corresponding pivoting axis substantially perpendicular to said oscillating axis;

wherein said pivoting means comprise alignment means ensuring an extended relationship between said guiding element and one of said oscillating arm to enable free pivoting of the guide element around said pivoting axis for free balancing the tension of the tracks of the printing ribbon for each position of the oscillating arms, wherein said pivoting means and said alignment means comprise for each guide element:

a supporting stem of said guiding element which extends substantially perpendicular to the plane of said external run;

two rib members supported by the end of said one oscillating arm and defining a seat means engageable by the supporting stem of said guiding element to define said pivoting axis, wherein one of said rib members is, in use, adjacent to said platen roller and the other rib member is spaced apart from said one rib member along the one oscillating arm; and means for limiting axial movements of the supporting stem with respect to said seat means comprising a notched portion of the stem and a tooth element of the oscillating arm.

4. A cartridge according to claim 3, wherein said seat means is defined by a sleeve interconnecting said two rib members, and wherein said means for limiting the axial movements of the stem comprise said notched portion at one end of said supporting stem and said tooth element supported by the oscillating arm and engageable with the notched portion of said stem.

5. A cartridge for a printing ribbon for a typewriter of the type comprising a platen roller having a typing point, said cartridge comprising a printing ribbon having a plurality of tracks which can be selected for the printing operation, a casing for housing the printing ribbon, a pair of oscillating arms carrying two corresponding guide elements for guiding an external run of printing ribbon, oscillation supporting means for oscillatably mounting said oscillating arms in said casing around an oscillating axis, wherein said oscillating axis is parallel, in use, to the platen roller and wherein said oscillating arms are movable from a rest position wherein the typing point is visible to successive printing positions wherein the plurality of tracks are selectively positionable in front of the typing point, and uniforming means for making uniform the tension on said tracks during the oscillations of said oscillating arms, said uniforming means comprising:

said guide elements comprise two corresponding edges which define a common plane for said external run of printing ribbon; and pivoting means for pivotally mounting each guiding element on a first end of said oscillating members and around a corresponding pivoting axis substantially perpendicular to said oscillating axis;

wherein said pivoting means comprise alignment means ensuring an extended relationship between said guiding element and one of said oscillating arm to enable free pivoting of the guide element around said pivoting axis for free balancing the tension of the tracks of the printing ribbon for each position of the oscillating arms, and wherein said pivoting means and said alignment means comprise for each guide element;

a supporting stem of said guiding element which extends substantially perpendicular to the plane of said external run;

a central sleeve supported by a first end of each oscillating arm, wherein said central sleeve has a cylindrical seat for freely housing the cylindrical stem of the corresponding guide element; and means for preventing disengagement of the cylindrical stem from the cylindrical seat comprising a notched portion at one end of the cylindrical stem and a tooth element engageable with the notched portion of said cylindrical stem.

* * * * *